US007073829B2

(12) United States Patent
Kuo et al.

(10) Patent No.: US 7,073,829 B2
(45) Date of Patent: Jul. 11, 2006

(54) RESTORING STRUCTURE OF A LOCK

(75) Inventors: Ching-Chuan Kuo, Chiayi (TW); Lan-Kun Don, Chiayi (TW); Tsung-Chung Huang, Chiayi (TW)

(73) Assignee: Tong Lung Metal Industry Co., Ltd., Chiayi (TW)

( * ) Notice: Subject to any disclaimer, the term of this patent is extended or adjusted under 35 U.S.C. 154(b) by 93 days.

(21) Appl. No.: 10/825,091

(22) Filed: Apr. 15, 2004

(65) Prior Publication Data

US 2004/0227361 A1 Nov. 18, 2004

(30) Foreign Application Priority Data

Apr. 17, 2003 (TW) ..... 92206233 U

(51) Int. Cl.
*E05B 15/02* (2006.01)

(52) U.S. Cl. ..... 292/357; 292/336.3

(58) Field of Classification Search ..... 292/336.3, 292/348, 357; 70/224
See application file for complete search history.

(56) References Cited

U.S. PATENT DOCUMENTS 2,778,667 A * 1/1957 Young ..... 292/352
5,125,696 A * 6/1992 Robida et al. ..... 292/169.16
5,666,833 A * 9/1997 Gao et al. ..... 70/224
5,887,465 A * 3/1999 Shen ..... 70/224
6,386,602 B1 * 5/2002 Lan ..... 292/336.3
6,575,006 B1 6/2003 Don

* cited by examiner

*Primary Examiner*—Gary Estremsky
(74) *Attorney, Agent, or Firm*—Ladas and Parry LLP

(57) ABSTRACT

A restoring structure of a lock comprises: a sleeve disk, having a first wall and a second wall, the first wall interconnecting a first face and a second face, and the second wall interconnecting the second face and a third face, the first face and the second face defining a recess, the first face further having a projection, and the second wall defining a central hole; an integrally formed rotative tube, inserted through the central hole of the sleeve disk, and having an end which is formed with a bent portion at a location corresponding to the projection of the sleeve disk and has at least one protrusion disposed at a predetermined position, the protrusion abutting against the first face of the sleeve disk; a torsion spring having two legs, adapted to fit onto an outer wall of the rotative tube such that the legs engage on the bent portion of the rotative tube and the projection of the sleeve disk; and a guard ring disposed adjacent to the third face of the sleeve disk and adapted to engage with at least one lateral slot formed on the rotative tube; whereby when the rotative tube is rotated clockwise or counterclockwise at a desired angle, the torsion spring is compressed to create an elastic deformation such that the at least one protrusion of the rotative tube runs toward the projection of the sleeve disk, and when the rotative tube is released, the rotative tube is returned to its original position by a restoration force of the torsion spring.

4 Claims, 3 Drawing Sheets

RESTORING STRUCTURE OF A LOCK

BACKGROUND OF THE INVENTION

1. Field of the Invention

The present invention generally relates to a restoring structure of a lock, particularly to a restoring structure of a door lock, which is simple in structures and can stably restore either the inside or the outside handle of the door lock to its original position after a long-term use.

2. Description of the Related Art

A conventional restoring mechanism, such as that disclosed in FIG. 4 of U.S. Pat. No. 6,575,006, is disclosed in FIG. 1, which comprises a rotative spring seat 47, a handle actuation tube 45, two fixing blocks 44, a sleeve disk 49, a first guard ring 50, a second guard ring 43, and a rotative ring spring 48.

The rotative ring spring 48 is mounted on the exterior surface of the rotative spring seat 47 and is installed in a hole 491 of the sleeve disk 49. The rotative ring spring 48 is further fixed into a first guard ring slot 472 of the rotative spring seat 47 by the first guard ring 50 and thus, the rotative spring seat 47 is rotatably and axially positioned on the sleeve disk 49. The rotative ring spring 48 has two legs 481 which adjacently resist against two sides of a projection 492 on the sleeve disk 49. Therefore, when the rotative spring seat 47 is rotated, a protruding leg 475 on the rotative spring seat 47 triggers one of the legs 481 of the rotative ring spring 48. Because the other leg 481 still resists against the projection 492 of the sleeve disk 49, a restoration force is thereby produced for turning the rotative spring seat 47 back to its original position prior to rotation.

The handle actuation tube 45 is a hollow tube having a first end 451 passing through a hole 471 of the rotative spring seat 47. The handle actuation tube 45 further has a second end 452 with two radially opposing holes 453 and four radially spaced projections 454.

The two fixing blocks 44 are generally arcuate and have projections 441 radially extending from the inner wall of the fixing blocks 44. The fixing blocks 44 are positioned in the hole 471 of the rotative spring seat 47 such that the projections 441 pass through the holes 453 of the handle actuation tube 45. The fixing block 44 has notches 442 to be meshed with the projections 454 of the handle actuation tube 45. The second guard ring 43 is positioned adjacent to the second end 452 of the handle actuation tube 45 and is fixed into a second guard ring slot 473 of the rotative spring seat 47. Accordingly, the second end 452 of the handle actuation tube 45 is axially positioned in the hole 471 of the rotative spring seat 47. The fixing block 44 has engagement parts 443, which are the resisting surfaces formed at the arcuate edges of the fixing block 44. The engagement parts 443 respectively engage with and resist against the two engagement parts 474 of the rotative spring seat 47. Therefore, when the handle actuation tube 45 is rotated, the fixing blocks 44 and the rotative spring seat 47 will also be rotated accordingly.

However, because the above structure comprises numerous members, it is very complex and difficult to assemble in a factory.

BRIEF SUMMARY OF THE INVENTION

To overcome the above disadvantages, the present invention modifies the restoring structure disclosed in FIG. 4 of U.S. Pat. No. 6,575,006 by integrating the rotative spring seat 47, the handle actuation tube 45, the two fixing blocks 44 and the second guard ring 43 into a single member.

The primary objective of the present invention is to provide a restoring structure of a lock, which has an integrally formed rotative tube. Further, the present invention has a simple structure and high stability such that it can restore the inside or the outside handle back to its original position after a long-term use.

To achieve the above objectives, the restoring structure of a lock in accordance with the present invention comprises: a sleeve disk, having a first wall and a second wall, the first wall interconnecting a first face and a second face, and the second wall interconnecting the second face and a third face, the first face and the second face defining a recess, the first face further having a projection, and the second wall defining a central hole; an integrally formed rotative tube, inserted through the central hole of the sleeve disk, and having an end which is formed with a bent portion at a location corresponding to the projection of the sleeve disk and has at least one protrusion disposed at a predetermined position, the protrusion abutting against the first face of the sleeve disk; a torsion spring having two legs, adapted to fit onto an outer wall of the rotative tube such that the legs engage on the bent portion of the rotative tube and the projection of the sleeve disk; and a guard ring disposed adjacent to the third face of the sleeve disk and adapted to engage with at least one lateral slot formed on the rotative tube; whereby when the rotative tube is rotated clockwise or counterclockwise at a desired angle, the torsion spring is compressed to create an elastic deformation such that the at least one protrusion of the rotative tube runs toward the projection of the sleeve disk, and when the rotative tube is released, the rotative tube is returned to its original position by a restoration force of the torsion spring.

BRIEF DESCRIPTION OF THE DRAWINGS

The objectives, spirits and advantages of the preferred embodiments of the present invention will be readily understood by persons skilled in the art from the accompanying drawings and detailed descriptions, wherein.

DETAILED DESCRIPTION OF THE INVENTION

Figure 1:
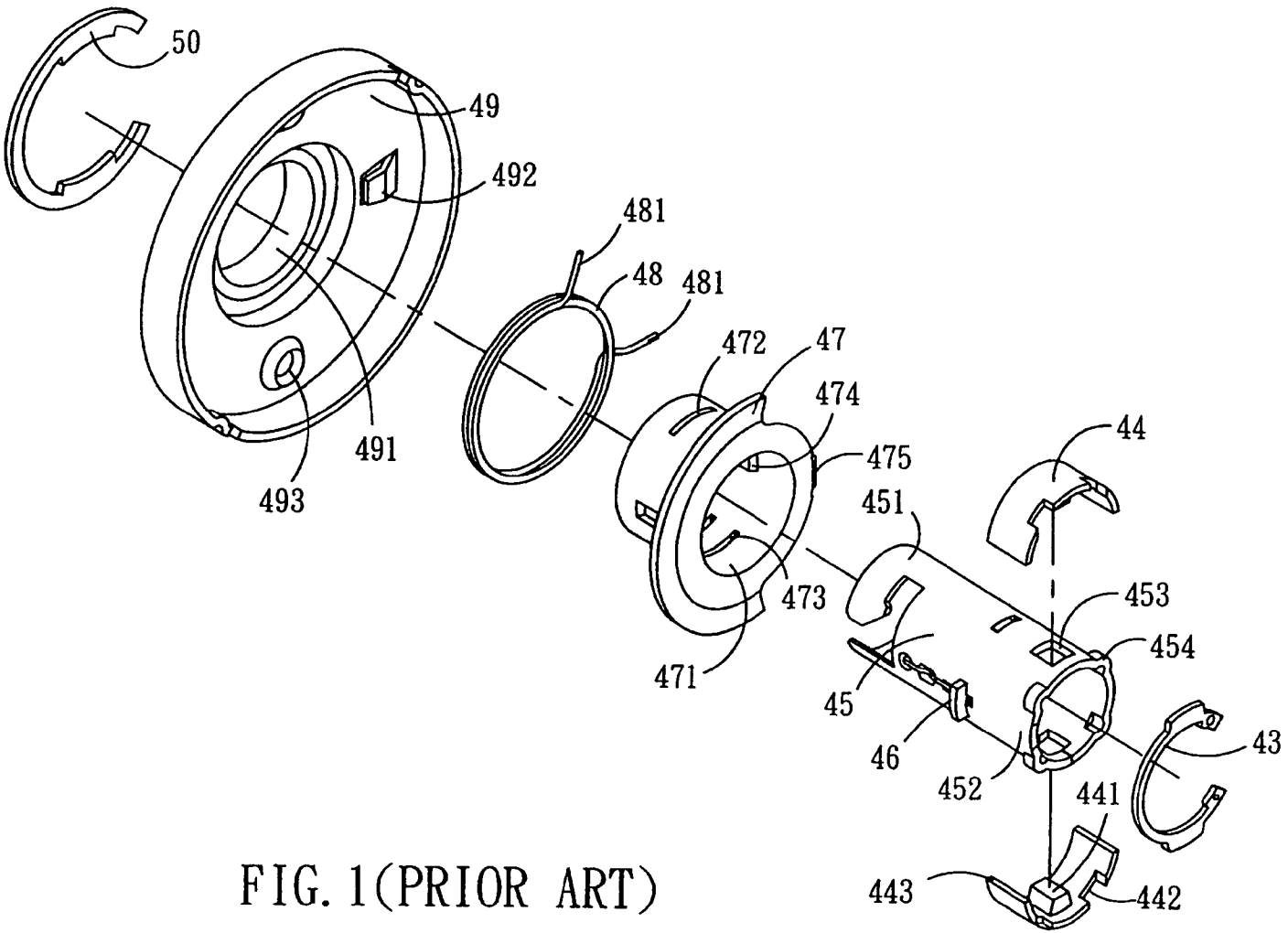
FIG. 1(PRIOR ART)
FIG. 1 is an exploded view of a conventional restoring mechanism.
Figure 2:
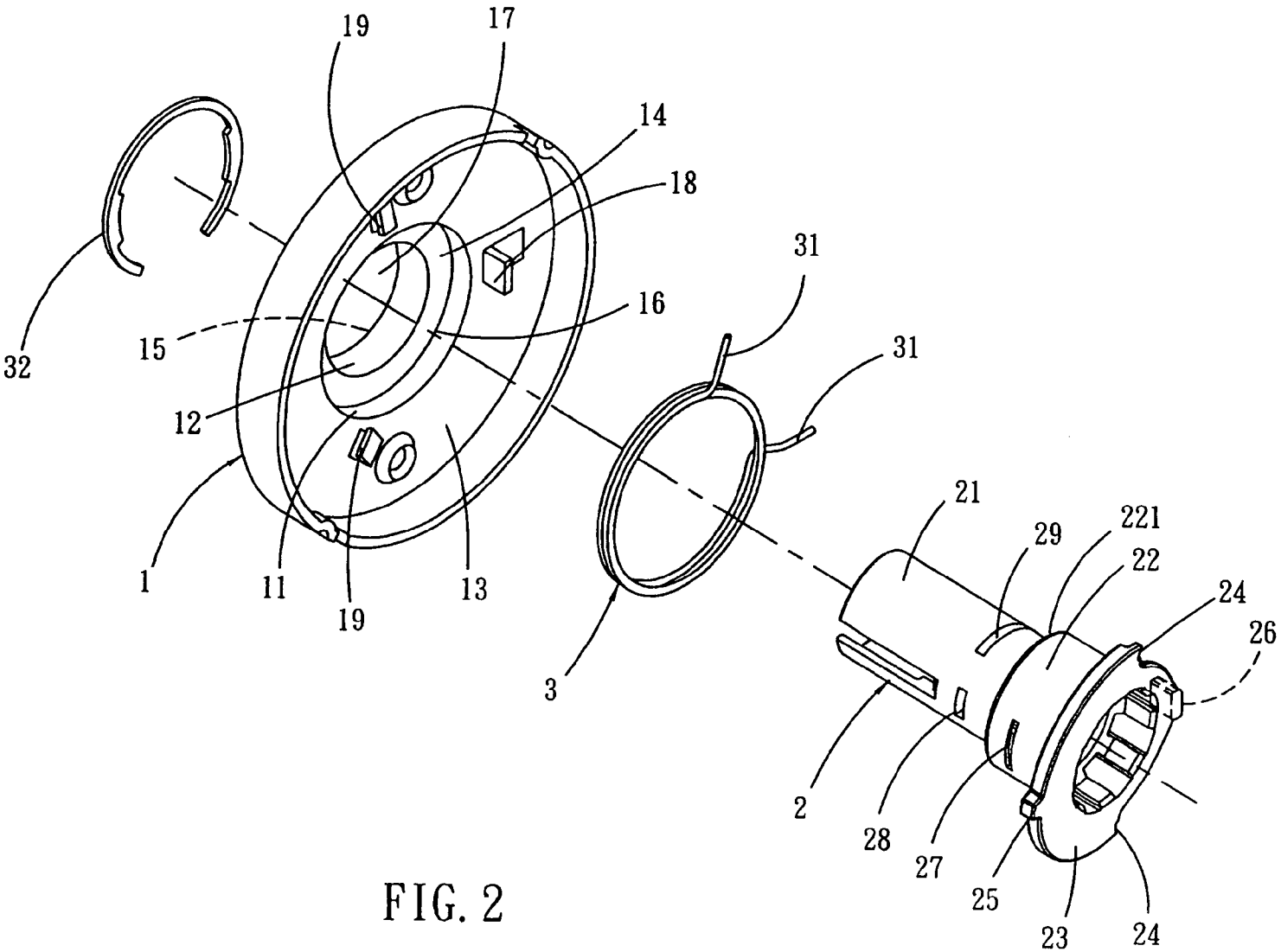
FIG. 2 is an exploded view of the restoring structure of a lock in accordance with a preferred embodiment of the present invention.

FIG. 2 shows an exploded view of a restoring structure in accordance with a preferred embodiment of the present invention, which comprises a sleeve disk 1, a rotative tube 2, a torsion spring 3 and a guard ring 32.

The sleeve disk 1 has a first wall 11 and a second wall 12, wherein the first wall 1 interconnects a first face 13 and a second face 14, and the second wall 12 interconnects the second face 14 and a third face 15. A recess 16 is further defined between the first face 13 and the second face 14. Moreover, a projection 18 and two projected portions 19 are formed on the first face 13, with two projected portions 19 adjacent to the projection 18. The second wall 12 defines a central hole 17.

The rotative tube 2 is integrally formed and is inserted through the central hole 17 of the sleeve disk 1. The rotative tube 2 has a first tube 21 and a second tube 22 along its axial axis. A first end of the first tube 21 may be used to fit with a grip, an L-shaped handle or the similar (not shown). A shoulder 221 is formed at the end of the second tube 22 which connects with the first end 21, while the other end of the second tube 22 defines a radial flange 23. A bent portion 26 is axially formed on the flange 23 and corresponds to the projection 18 of the sleeve disk 1. In addition, two protrusions 24 and an extending block 25 are formed at the predetermined positions on the flange 23, with the projections 24 abutting against the first face 13 of the sleeve disk 1.

Figure 3:
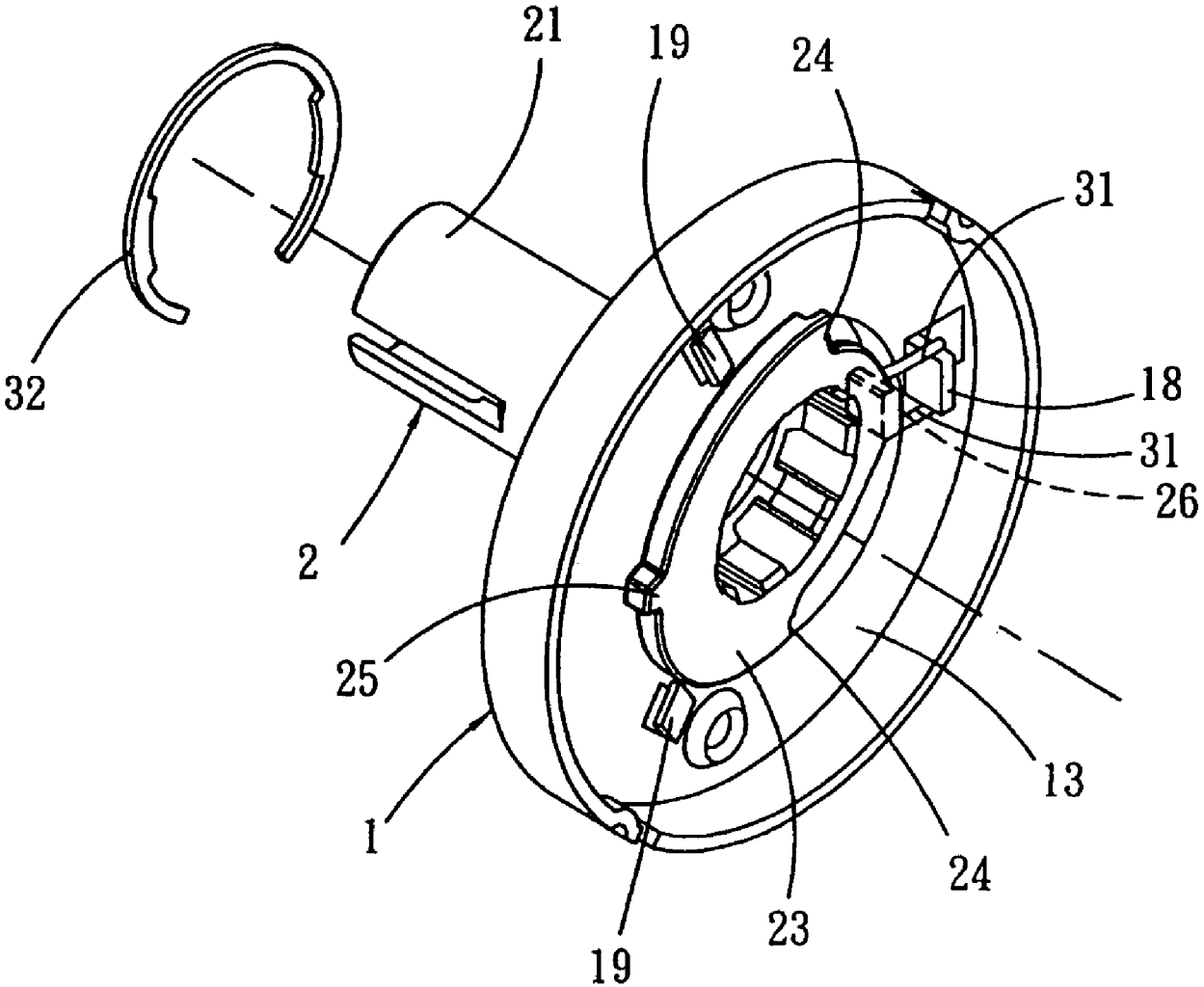
FIG. 3 is another exploded view of the restoring structure of a lock in accordance with the preferred embodiment of the present invention, wherein the guard ring is separate from the subassembly comprising the rotative tube, the torsion spring and the sleeve disk.

The torsion spring 3 has two legs 31 and is fitted between the outer wall of the second tube 22 and the bent portion 26 of the rotative tube 2 such that the legs 31 engage on the bent portion 26 of the rotative tube 2 and the projection 18 of the sleeve disk 1 (see FIG. 3).

The guard ring 32 is disposed adjacent to the third face 15 of the sleeve disk 1 and engages with two lateral slots 27 (only one slot is shown) formed on the rotative tube 2.

As shown in FIG. 3, after the above members are assembled, by rotating the rotative tube 2 clockwise or counterclockwise at a desired angle, the torsion spring 3 is compressed to create an elastic deformation such that one of the protrusions 24 of the rotative tube 2 runs toward the projection 18 of the sleeve disk 1. Moreover, the extending block 25 can abut against one of the projected portions 19 of the sleeve disk 1 so as to prevent the rotative tube 2 from improper torsion force, as well as the torsion destruction resulted from a further rotation. When the rotative tube 2 is released, the rotative tube 2 is returned to its original position by a restoration force of the torsion spring 3.

Since the rotative tube 2 is integrally formed, a first groove 28 and a second groove 29 can be formed on the first tube 21 of the rotative tube 2 for laterally receiving a plate (not shown) therein. Moreover, a spring is inserted into the first tube 21 for controlling the plate to partially extend out of the first tube 21 or retract back to the first tube 21, so as to provide the aforementioned engagement between the first tube 21 and the grip, the L-shaped handle or the similar.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

SEQUENCE LISTING

1 sleeve disk
11 first wall
12 second wall
13 first face
14 second face
15 third face
16 recess
17 central hole
18 projection
19 projected portion
2 rotative tube
21 first tube
22 second tube
221 shoulder
23 flange
24 protrusion
25 extending block
26 bent portion
27 lateral slot
28 first groove
29 second groove
3 torsion spring
31 leg
32 guard ring

What is claimed is:

1. A restoring structure of a lock, comprising:

a sleeve disk, having a first wall and a second wall, the first wall interconnecting a first face and a second face, and the second wall interconnecting the second face and a third face, the first face and the second face defining a recess, the first face further having a projection and at least one projected portion, and the second wall defining a central hole;

an integrally formed rotative tube, inserted through the central hole of the sleeve disk, and having an end which is formed with a bent portion at a location corresponding to the projection of the sleeve disk and has at least one protrusion and an extending block disposed at predetermined positions, the protrusion abutting against the first face of the sleeve disk;

a torsion spring having two legs, adapted to fit onto an outer wall of the rotative tube such that the legs engage on the bent portion of the rotative tube and the projection of the sleeve disk; and a guard ring disposed adjacent to the third face of the sleeve disk and adapted to engage with at least one lateral slot formed on the rotative tube;

whereby when the rotative tube is rotated clockwise or counterclockwise at a desired angle, the torsion spring is compressed to create an elastic deformation such that the at least one protrusion of the rotative tube runs toward the projection of the sleeve disk and the extending, block of the rotative tube is adapted to abut against the projected portion of the sleeve disk, and when the rotative tube is released, the rotative tube is returned to its original position by a restoration force of the torsion spring.

2. The restoring structure of a lock according to claim 1, wherein the rotative tube comprises a first tube and a second tube along its axial axis, the second tube connecting with the first tube and defining a.shoulder at an end where it connects with the first tube.

3. The restoring structure of a lock according to claim 2, wherein the second tube is provided with a radial flange at an end opposing the shoulder, and the bent portion, the at least one protrusion, and the extending block are formed on the flange.

4. The restoring structure of a lock according to claim 1 wherein said at least one projected portion on the first face of the sleeve disc projects radially inwards thereof and the extending block on the rotative tube extends radially outwards on the rotative tube such that the extending block can abut against the at least one projected portion of the sleeve disc to limit torsion force of the spring.

* * * * *